US007198090B1

(12) United States Patent
Kershaw

(10) Patent No.: US 7,198,090 B1
(45) Date of Patent: Apr. 3, 2007

(54) SCREEN DOOR LATCH GUARD PLATE

(76) Inventor: Thomas Kershaw, 5626 Riverside Dr., Cape Coral, FL (US) 33904

( * ) Notice: Subject to any disclaimer, the term of this patent is extended or adjusted under 35 U.S.C. 154(b) by 0 days.

(21) Appl. No.: 11/377,801

(22) Filed: Mar. 16, 2006

(51) Int. Cl.
*A47G 5/00* (2006.01)
*E05B 17/00* (2006.01)

(52) U.S. Cl. ..... 160/371; 292/346; 16/DIG. 24; 49/460

(58) Field of Classification Search ..... 292/346, 292/336.3, DIG. 2; 20/417; 160/371; 49/57, 49/460; 16/DIG. 24
See application file for complete search history.

(56) References Cited

U.S. PATENT DOCUMENTS 4,185,859 A * 1/1980 Cunningham ..... 292/93
5,076,626 A * 12/1991 Tiddy et al. ..... 292/337
5,379,821 A * 1/1995 Pergolizzi et al. ..... 160/371
5,802,765 A * 9/1998 Vickery ..... 49/67

* cited by examiner

*Primary Examiner*—Gary Estremsky

(57) ABSTRACT

A combination of a screen door latching apparatus, commonly having a small indoor push handle and a substantially thin guard plate that becomes retained between the handle housing and a frame of the screen door. The guard plate is elongated and protects the screening material from accidental hand abuse. The combination also enhances security by means of the guard plate by shielding the door latch locking trigger from outside view and access. The prominent guard plate helps occupants to quickly identify the door latch location, assisting a hurried egress. The guard plate helps to guide ones fingers toward the small locking trigger of the door latch which is particularly important during panic situations.

4 Claims, 1 Drawing Sheet

SCREEN DOOR LATCH GUARD PLATE

FIELD OF THE INVENTION

The subject invention relates to a combination of a screen door latch and an affixed guard plate to prevent the screen material from being damaged by the closeness of the fingers of a hand when manipulating the latch.

BACKGROUND OF THE INVENTION

Screen door latching devices of various types are well known. Such latches are normally selectively positioned on screen doors and include familiar small knobs, levers, and push handles as described in U.S. Pat. No. 4,632,439. The small hand control of the latch of the latch apparatus can be difficult to locate, grasp and operate without causing damage to the nearby and underlying screening material. Particular under duress. It is well known that screening material has been damaged by jewelry worn on the fingers of the user and by bracelets worn on the wrist of a user of the screen door.

U.S. Pat. No. 3,838,539 describes a screen edge protector apparatus specifically for use near handles of laterally sliding screen doors. The protective plate is part of the handle assembly and included therein and directly overlies or is in contact with the screening material.

U.S. Pat. No. 4,286,812 and U.S. Pat. No. 4,578,967 describe screen door lock mechanisms including dead bolts. These complex devices are adaptable to screen doors for security concerns, but are costly and may require advanced skill for installation. These inventions do not address issues of screen protection or handle visibility.

U.S. Pat. No. 4,330,022 describes a two piece guard that interlocks with itself to enclose, reinforce and protect screen material of slider doors for accidental disturbance. The device fails to address problems associated with door latches, locks and home security.

U.S. Pat. No. 4,788,745 describes an apparatus that protects screen material while providing a high visibility handle location. The invention is described as a secondary handle with no latching or locking features. Installation of this device multiple parts, fasteners, and door modification and is lacking desired security advantages.

U.S. Pat. No. 4,864,835 describes a screen door latch of familiar shape like the previously mentioned U.S. Pat. No. 4,632,439 but with an added key operated lock. While this apparatus addresses the need for security, it requires a complete replacement of the less complicated non-keyed door latch. Both of these door latches devices can improve their visibility, security and function as part of the combination invention at hand.

U.S. Pat. No. 5,379,821 describes a screen guard plate shaped to border and surround the existing pull handle of the screened slider door. Screws and mechanical mounting are required for alteration to the door.

SUMMARY OF THE INVENTION

The subject invention provides for a screen door latch in combination with a noticeable guard plate, whereby someone can quickly locate and more comfortably operate the latch handle without concern of damaging nearby screening. The guard plate provides finger guidance toward the latch locking trigger while shielding the lock trigger from the view of outsiders.

Briefly, the invention comprises a combination of a screen door latch apparatus and slotted plate of noticeable size. The substantially thin guard plate is slid under the door latch housing and secured by adjusting or manipulating existing screws.

The guard plate extends to cover and protect nearby screening from inadvertent abuse. The guard plate helps guide ones fingers to the door latch locking trigger, particularly during panic. The guard plate adds security by shielding the latch locking trigger from outsiders.

DETAILED DESCRIPTION OF THE INVENTION

Figure 1:
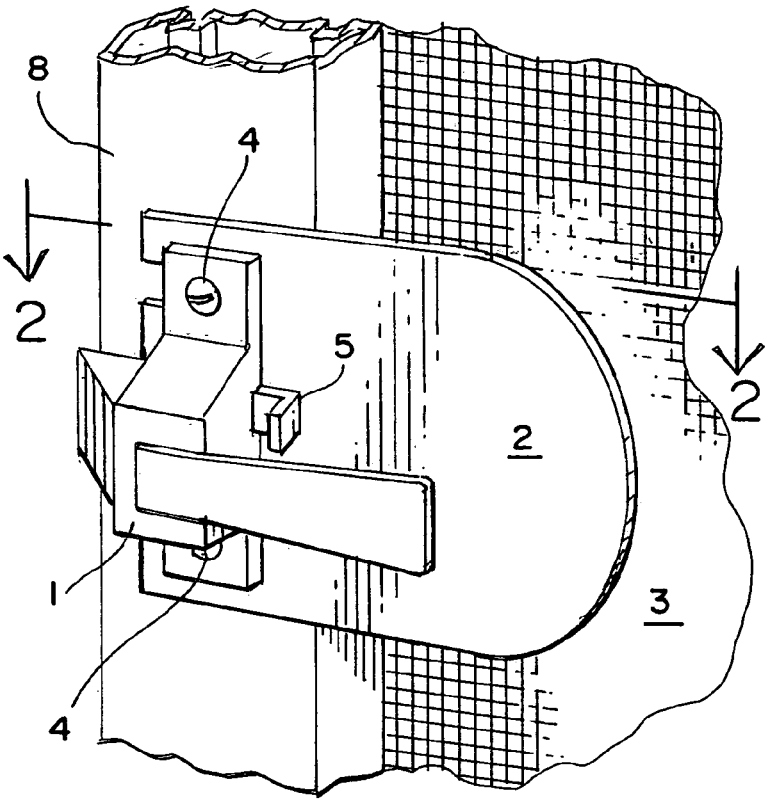
FIG. 1 is a perspective view of the combination screen door latch and the inventive guard plate.
Figure 3:
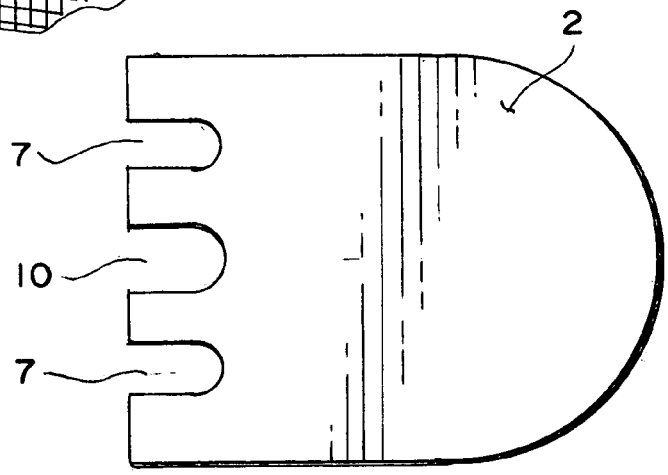
FIG. 3 is a perspective view of the guard plate prior to assembly.
Figure 2:
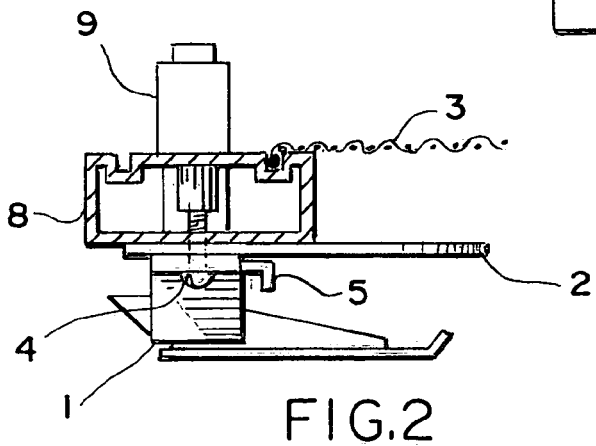
FIG. 2 is a cross sectional view of the screen door taken along the line 2—2 of FIG. 1 to illustrate the assembly of the combined apparatus.

Reference is now made to the FIGS. 1–3, wherein like parts are referred to by like numbers.

FIG. 1 shows the combination apparatus in an assembled state after having been installed on a screen door 8. The simplistic guard plate is slid under and/or beneath the commonplace latch handle housing after the housing screws 4 have been loosened. FIG. 2 shows the guard plate 2 after it has been slipped under the housing 1 attached to door frame 8. The guard plate extends over an area of the screen material 3 for protection from inadvertent damage. The trigger lock 5 is also protected from view and manipulation from the outside of the door frame which thereby affords the protective purpose. Door handle 4 is also shielded from outsiders.

FIG. 2 illustrates the door latch housing in combination with the guard plate 2 which extends away from the screening material 3 by the size and thickness of the door frame 8. The latch cannot be operated from the outside of the door by way of the push button 9 as long as the shielded locking trigger 5 is locked.

FIG. 3 is a perspective view of the guard plate 2 by itself. The area extended over the screening material 3 is rounded for esthetic reasons although different contours could be used. The side of the guard plate 2 facing the door frame 8 is straight. The straight side has an upper and lower recess 7 therein which is instrumental to enable the plate 2 to be slipped passed the screws 4 as the plate is installed. There is also shown a central recess 10 which will provide clearance for any parts that may be present in the underside of the housing 1.

OPERATION

By combining a familiar and commonplace screen door latch with an appropriate guard plate one can effectively overcome the above noted shortcomings of the prior art and gain novel advantages. The combination invention is simplistic in nature and requiring only a substantially thin, inexpensive guard plate to be slid beneath the familiar door latch housing. The guard plate thereby is held in place by way of friction because once the housing screws have been tightened, the guard plate will be held in place and cannot be removed without loosening the housing screws. Furthermore, no door alterations are required and no special tools are needed but just a screwdriver to loosen and/or tighten the housing screws.

The guard plate of the combination invention is prominently visible to assist anyone seeking the latch or lock, particularly in a hurried egress or emergency.

The guard plate protects the immediate screen area from harmful contact.

The guard plate helps fingers to find the latch locking trigger.

The guard plate hides the locking trigger from an outsider's view.

In its simplest form, only a screwdriver is needed to install the guard plate.

What I claim is:

1. A combination screen door latching apparatus mounted to a screen door including a housing with a guard plate, said guard plate is placed between said housing and a frame member of said screen door, said guard plate has at least three recesses along its straight edge and is held in place by way of friction, said guard plate extending over said screen of said door so that fingers of a person operating said latching apparatus cannot harm said screen.

2. The combination screen door latching apparatus of claim 1, wherein said friction is created by conventional screws of said housing fastening said housing to said door frame when tightened to retain said housing.

3. The combination screen door latching apparatus of claim 1, wherein said guard plate is a means for hiding said housing handle and said trigger lock from view from an outside of said screen door.

4. The combination screen door latching apparatus of claim 1, wherein said guard plate has a rounded edge and one straight edge.

* * * * *